US005961151A

United States Patent [19]

Tung et al.

[11] Patent Number: 5,961,151

[45] **Date of Patent: *Oct. 5, 1999**

[54] PHARMACEUTICAL MARKETING DEVICE AND METHOD OF USE

[75] Inventors: James C. Tung, Blue Bell; Norman Werther, Fort Washington, both of Pa.

[73] Assignee: Global Healthcomm, Inc., Abington, Pa.

[ * ] Notice: This patent is subject to a terminal disclaimer.

[21] Appl. No.: 09/082,569

[22] Filed: May 21, 1998

Related U.S. Application Data

[63] Continuation of application No. 08/439,730, May 12, 1995.

[51] Int. Cl.[6] ..... B42D 15/00

[52] U.S. Cl. ..... 283/56; 283/900; 283/116

[58] Field of Search ..... 283/115, 63.1, 283/900, 116, 61, 62; 281/2.5; 206/232

[56] References Cited

U.S. PATENT DOCUMENTS 5,805,498 9/1998 Tung et al. ..... 283/56

*Primary Examiner*—Willmon Fridie, Jr.
*Attorney, Agent, or Firm*—Caesar, Rivise, Bernstein, Cohen & Pokotilow, Ltd.

[57] ABSTRACT

Sampling device for marketing a drug by a pharmaceutical company includes multiple segments. One segment includes the drug to be sampled and another segment includes preprinted indicia on one side providing prescribing information for a prescriber of the drug and an adhesive layer on the other side for attachment to a patient's medical chart maintained by the prescriber of the drug. A method of sampling a drug employing the above described sampling device also forms a part of this invention.

7 Claims, 8 Drawing Sheets

PHARMACEUTICAL MARKETING DEVICE AND METHOD OF USE

RELATED APPLICATIONS

This application is a continuation of pending U.S. application Ser. No. 08/439,730, entitled PHARMACEUTICAL MARKETING DEVICE AND SYSTEM, which was filed on May 12, 1995.

BACKGROUND OF THE INVENTION

This invention relates generally to the field of marketing pharmaceutical products, and more specifically to a pharmaceutical marketing device and system which enables the pharmaceutical company to communicate effectively with the persons involved in the use and dispensing of the product, e.g., the prescribing physician or prescriber, the patient or recipient, and the pharmacist or dispenser.

Various devices for marketing and testing pharmaceutical products are known. U.S. Pat. No. 3,625,547 (Burke) discloses a composite prescription form comprising five individual parts, including a detachable part to be used as a prescription label, another which is used as a stack label, a third part constituting the prescription, a fourth part which is a copy of the original prescription and a fifth part secured to the patient's prescription ledger card. This form is intended to reduce the average amount of time used by pharmacists in filling a prescription.

U.S. Pat. No. 5,178,418 (Bolnick) comprises a multi-segment form with labels. The first and second label segments contain information identifying the patient participating in a drug study, the drug being tested and other study information. The third label contains hidden information on whether the particular patient has been prescribed a drug or a placebo. The hidden information may be uncovered by the physician if the patient's condition deteriorates.

U.S. Pat. No. 4,526,404 (Vasquez) discloses a label bearing container holding clinical products such as blood products. The label can be removed and attached to the patient's chart to indicate that the clinical product was administered to the patient.

Various other devices for marketing products are known including a prescription form which incorporates a sample of the drug to be administered; as well as other composite marketing devices, such as those used in the sale of photographic film, which incorporate a mailer to return the exposed film to the company for processing.

However, the prior art does not disclose a marketing device and system which is capable of establishing and maintaining communications between the pharmaceutical company or its designated representative, e.g., a marketing company or a database company, and the physician, patient, and pharmacist involved in the prescribing, use and dispensing of the drug. This device and system increases the effectiveness and efficiency of the marketing program for the drug by enabling the pharmaceutical company to communicate information about the drug and/or related disease state and to continuously follow-up with the physician, patient and pharmacist regarding effectiveness of the drug, side effects, dosages and other factors such as providing patient education and improving patient compliance involved in the treatment of the patient with the drug and to control sampling distribution and cost.

OBJECTS OF THE INVENTION

Accordingly, it is the general object of this invention to provide a pharmaceutical marketing device and system which increases the efficiency and effectiveness of marketing pharmaceutical products as compared to existing devices and systems.

It is a further object of this invention to provide a pharmaceutical marketing device and system which enables a pharmaceutical company to establish communications with the physician and/or the patient and/or the pharmacist involved in the prescribing, use and marketing of a drug.

It is still a further object of this invention to provide a pharmaceutical marketing device and system which enables maintaining of communications with the physician, patient and pharmacist during the initial prescribing and usage and dispensing of the drug.

It is yet a further object of this invention to provide a pharmaceutical marketing device and system which maintains communication with the physician, patient and pharmacist during the period of treatment of the patient with the drug.

It is still yet a further object of this invention to provide a pharmaceutical marketing device and system, which includes a separable section which includes information for the physician regarding the drug which can be affixed to the patient's records.

It is indeed a further object of this invention to provide a pharmaceutical marketing device and system, which enables the pharmaceutical company or its agent to capture the patient's medical and/or prescription history with the patient's signed consent.

It is another object of this invention to provide a pharmaceutical marketing device and system which enables the physician to obtain and dispense free samples of the drug to the patient, and has the potential to help the physician utilize the drug more effectively.

It is yet another object of this invention to provide a pharmaceutical marketing device and system which has the potential to help the physician to utilize the drug more effectively.

It is still another object of this invention to provide a pharmaceutical marketing device and system, which enables the pharmaceutical company or its designated agent to receive identifying information including the names and addresses of the physician, patient and pharmacist for follow-up communications and monitoring of the effects of the drug during treatment.

It is yet another object of this invention to provide a pharmaceutical marketing device and system which enables the pharmaceutical company or its designated agent to reimburse the pharmacist for the dispensing of a free quantity of the drug to the patient.

It is also another object of this invention to provide a pharmaceutical marketing device and system, which enables the pharmaceutical company or its designated agent to effectively provide samples of drugs and tracking of these samples, reduce sampling costs, and to have pharmacists participate in the sampling process.

It is still yet another object of this invention to provide a pharmaceutical marketing device and system, which enables the pharmaceutical company to communicate recommendations to the physician on changes in the prescription dosage, frequency and method of use based upon the effectiveness of the drug or its side effects and management of those side effects during treatment.

It is indeed another object of this invention to provide a pharmaceutical marketing device and system which enables the pharmaceutical company or its designated agent to effectively provide education to the physician, patient and pharmacist regarding the prescription drugs.

SUMMARY OF THE INVENTION

These and other objects of this invention are achieved by a system and device which uses a multi-segment member comprising a plurality of separable elements for the marketing of a product. The multi-segment member, which in a preferred embodiment of this invention is a unitary member with separable sections, is delivered to the prescriber of the product (e.g., physician). It includes a separable section which the prescriber places upon the chart of the user (e.g., patient). It also has a separable segment or section with a free sample of the product which the prescriber gives to the user. In addition, another separable section includes information filled out by the physician or the pharmacist regarding the patient and the patient's medical history, and a section filled out by the dispenser of the product (e.g., pharmacist) giving information as to the dispenser's identity and location and the dispensing of a free quantity of the drug to the patient. The member also includes a mailer which is mailed by the pharmacist to the company purveying the product (or to its designated representative, e.g., a marketing or database company) so that the dispenser can be reimbursed for the cost of the free quantity of the product dispensed to the user and to convey information to the purveyor regarding the identity and address of the prescriber, user and dispenser.

DESCRIPTION OF THE DRAWING

These other objects of many of the intended advantages of this invention will be readily appreciated when the same becomes better understood by reference to the following detailed description. When considered in connection with the accompanying drawing, wherein.

DETAILED DESCRIPTION OF THE EMBODIMENTS

Figure 1A:
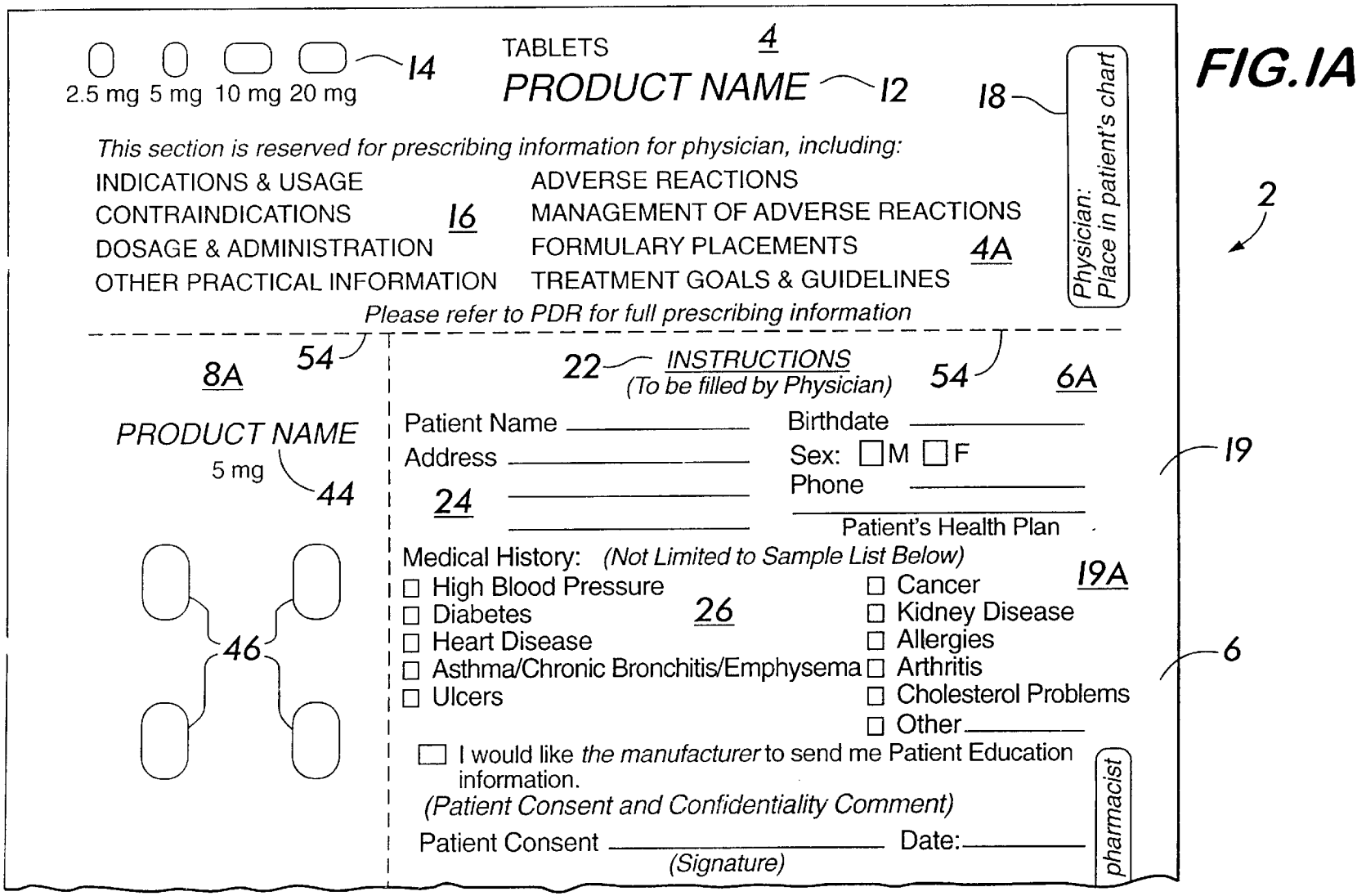
FIG. 1 is a view of the front of the first embodiment of the device.
Figure 1B:
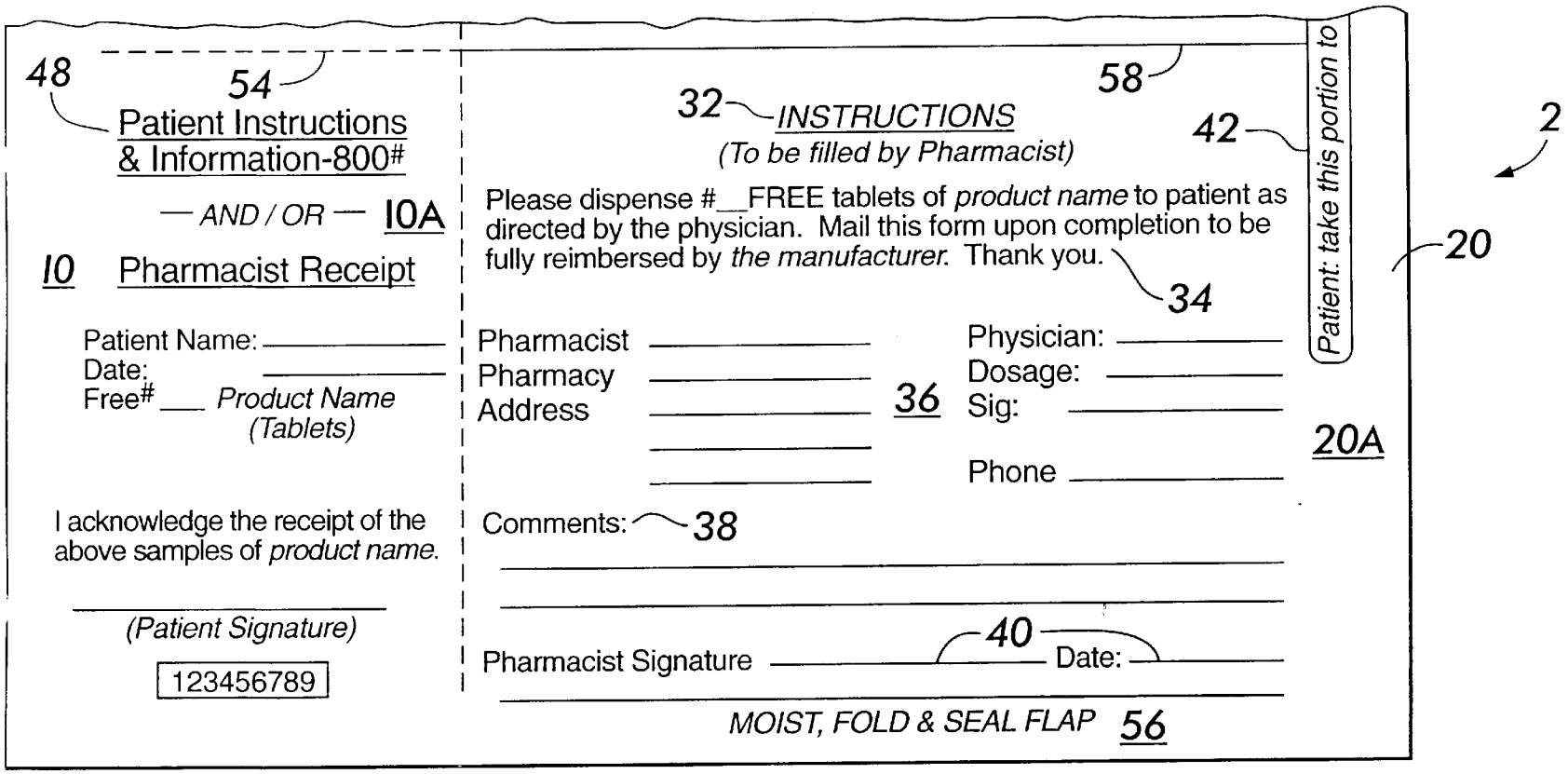
Figure 2A:
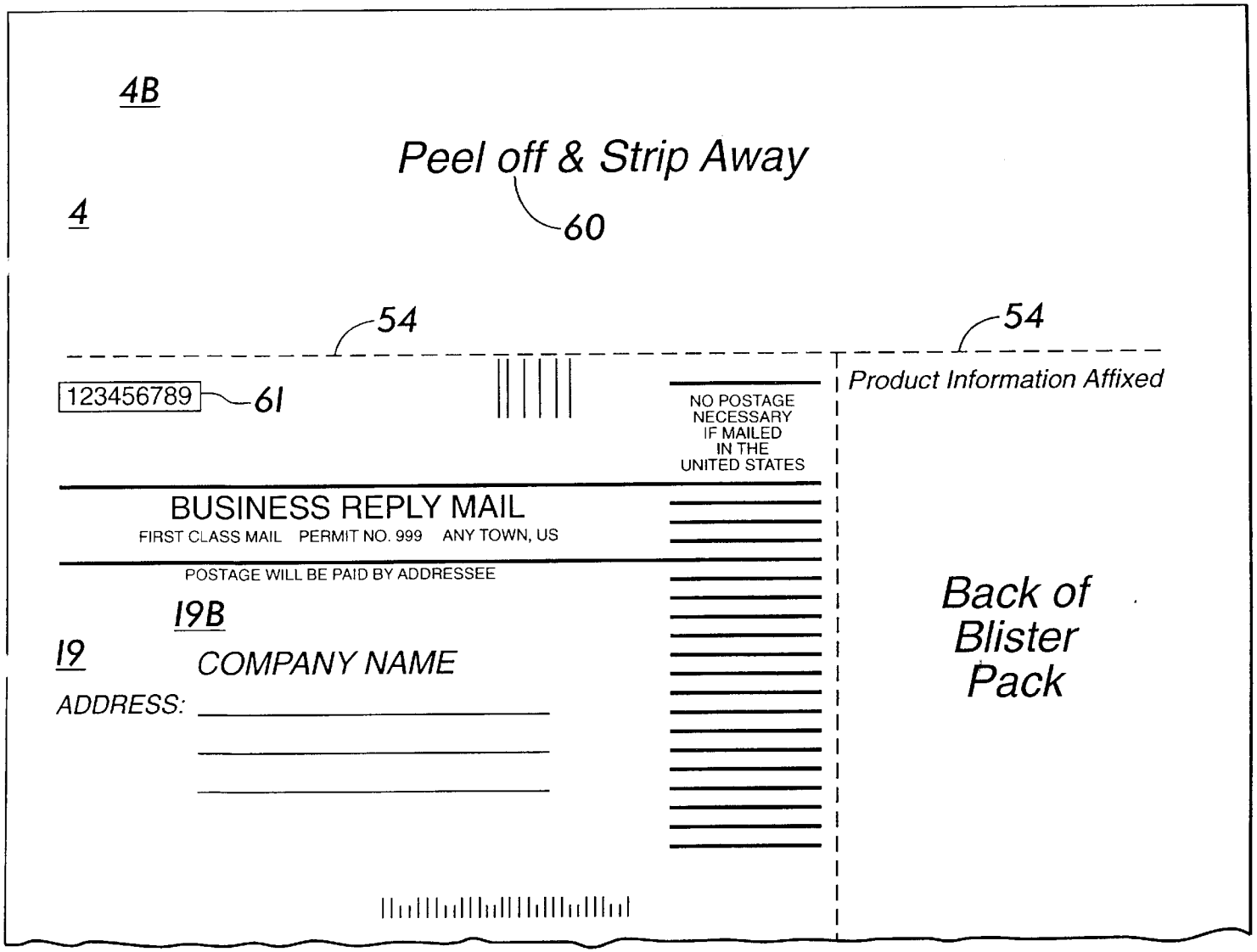
FIG. 2 is a view of the back of the device, which is the same for all embodiments of the device.
Figure 2B:
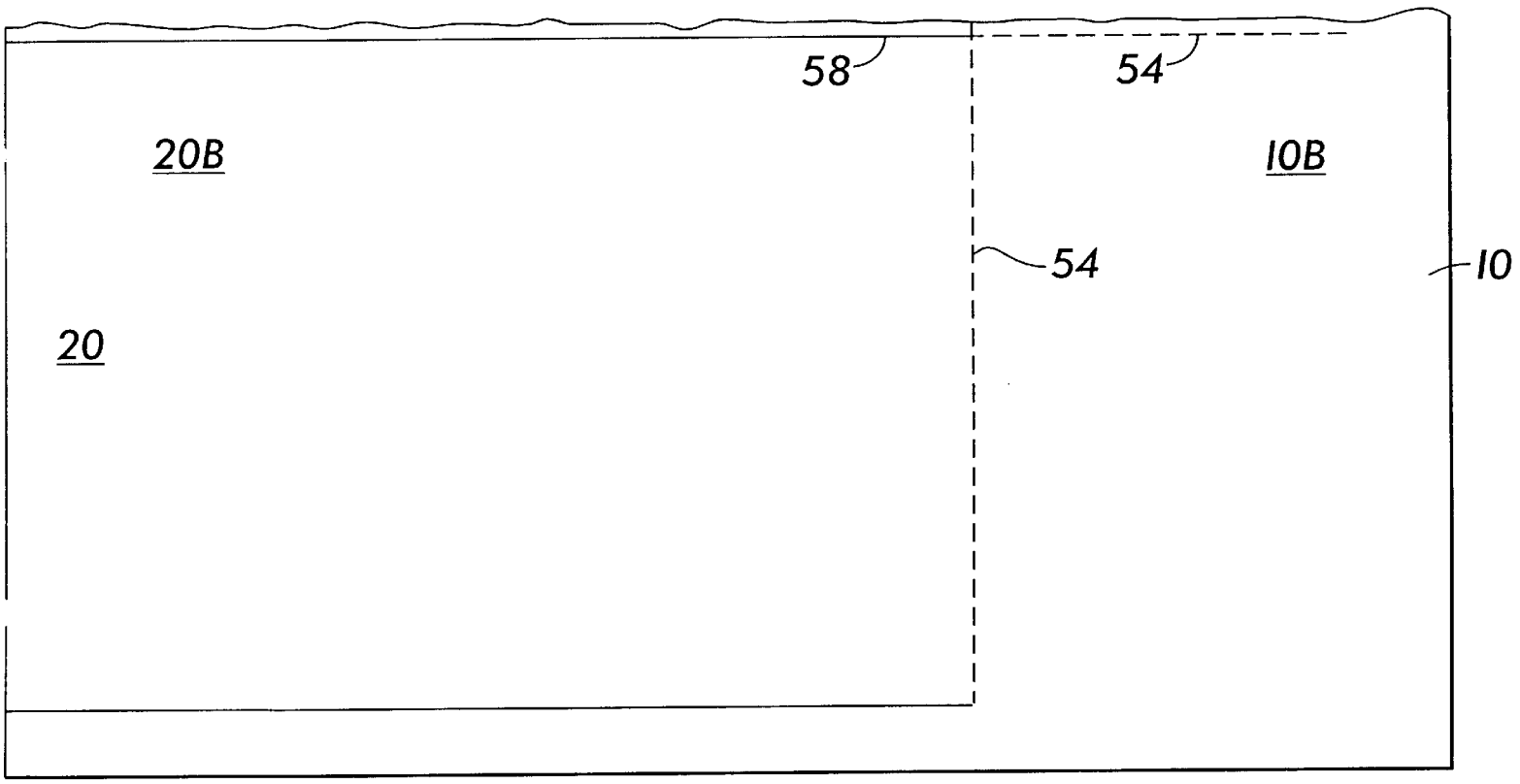

Referring now in greater detail to the various figures of the drawings, wherein like reference characters refer to like parts, there is shown in FIGS. 1 and 2 the marketing device 2 of the first embodiment of this invention. The marketing device 2 is a multi-segment member (in these embodiments it is a unitary member with separable sections). It is important to note that this invention is not only applicable to the marketing of a pharmaceutical product but to marketing of products in general. Therefore, references to pharmaceutical companies, drugs, physicians, patients and pharmacists are equally applicable to any company, any product and to the prescriber, user and dispenser or the product respectively.

Also, although the embodiments which are described below comprise four separable sections, this invention does not require that all four separable sections be used together. In fact, any combination of two or three sections also may be used in implementing this invention.

In this detailed description, the notations for the various sections on the front of the marketing device (FIGS. 1, 3 and 4) are given as numerals followed by the suffix "A". The back of the marketing device (FIG. 2) is given as numerals followed by the suffix "B". Thus, the front of the marketing device of FIGS. 1, 3 and 4 have notations 4A, 6A, 8A and so forth, and the rear of the marketing device have notations 4B, 6B, 8B and so forth.

Referring to FIG. 1, the marketing device 2 which is a multi-segment (unitary) device, comprises separable sections 4, 6, 8 and 10.

Section 4A has the name of the drug 12, the dosages available 14, and may include pictures of the medical product with different dosages in different colors and printed information 16 relating to the drug, taken from the PDR (Physician's Desk Reference) or package insert or information on the drug from the pharmaceutical company. Also, instructions 18 to the physician to place section 4 in the patient's chart are given. This section may also be folded or attached in a form to increase the number of segments of this section and to increase the information offered.

It should be noted that the information 16 relating to the drug is exemplary and the various categories of the information are subject to change by the pharmaceutical company.

Section 6 has two segments 19 and 20. Segment 19A is to be filled out by the prescribing physician or the pharmacist along with the patient and includes instructions 22; demographic information 24, which comprises the patient's name, address, birth date, sex and telephone number; the patient's medical history 26; an indication of whether the patient would like to be sent patient education information 28, and a signature line and date line 30 for the patient's consent to the release of confidential information relating to the patient's medical and/or prescription history.

Segment 20 of Section 6 is to be filled in by the pharmacist. It comprises segment 20A with instructions 32 to the pharmacist; a request 34 that the pharmacist dispense a prescribed amount of the drug free to the patient with instructions to mail the form back to the pharmaceutical company for full reimbursement; information relating to the name and address of the pharmacist and pharmacy; the physician's name; the dosage; the amount of the drug to be taken; and the phone number of the pharmacist. Space is also provided in segment 20 for comments 38 by the pharmacist and for the pharmacist's signature and date 40.

Included in Section 6A are instructions 42 to the patient to take the Section 6 to the pharmacist. Section 6A also includes instructions 56, at the bottom, to moisten, fold and seal the flap. Thus, after the Section 6 is separated via the perforations 54, it can be folded at line 58 and sealed, forming a mailer as will be explained below.

Section 8A of Section 8 is a separable section containing the name and dosage of the drug 44 and samples of the drug 46, and may include a package insert or simplified patient information. This Section 8 is separated from the marketing device 2 and is given as a free sample to the patient by the physician. Although the embodiment of Section 8 comprises a blister pack for holding the pills, any other form of container for the drug which is suitable can be used.

Section 10A comprises patient instructions and information 48 includes an 800 number for the patient to call the pharmaceutical company to receive information relating to the drug and/or a pharmacist receipt 50 which includes the patient's name, the date, the amount of the free drugs dispensed to the patient and a signature line 52 for the patient's signature to acknowledge receipt of the free amount of the drug dispensed to the patient. The receipt, or a copy thereof, may be submitted to the pharmaceutical company if the pharmacist is not reimbursed for the full amount of the drug in a reasonable amount of time after the mailer is posted.

As stated previously, the marketing device 2 is a unitary member comprising separable sections. Perforated lines 54 are used to separate the separable sections 4, 6, 8 and 10 in the embodiment shown in this specification. However, it should be noted that other means for obtaining separation can be used, such as score lines that weaken boundaries between the sections or lines which instruct the users to use a scissor to separate the sections.

FIG. 2 shows the back of the marketing device 2. Section 4B comprises instructions 60 to peel off the strip (or strips), to be affixed to the patient's chart, from a release liner. Although the embodiments shown herein describe a peel-off strip or strips for Sections 4, any other suitable method of attaching the information to the patient's chart can be used.

Segments 19B and 20B are the back of Section 6. Section 6 comprises a mailer for returning to the pharmaceutical company, or its designated representative, the information on the front of segments 19 and 20 (19A and 20A) relating to the physician, pharmacist and patient. When segments 19 and 20 are folded at line 58 and sealed, as previously described, a mailer is made available with the name and address 60 of the pharmaceutical company and the required postage 62 as shown in the back of segment 19. A code 61 for identifying the physician may also be included in Section 19B. Section 8B is the back of Section 8 and Section 10B is the back of Section 10.

Figure 3A:
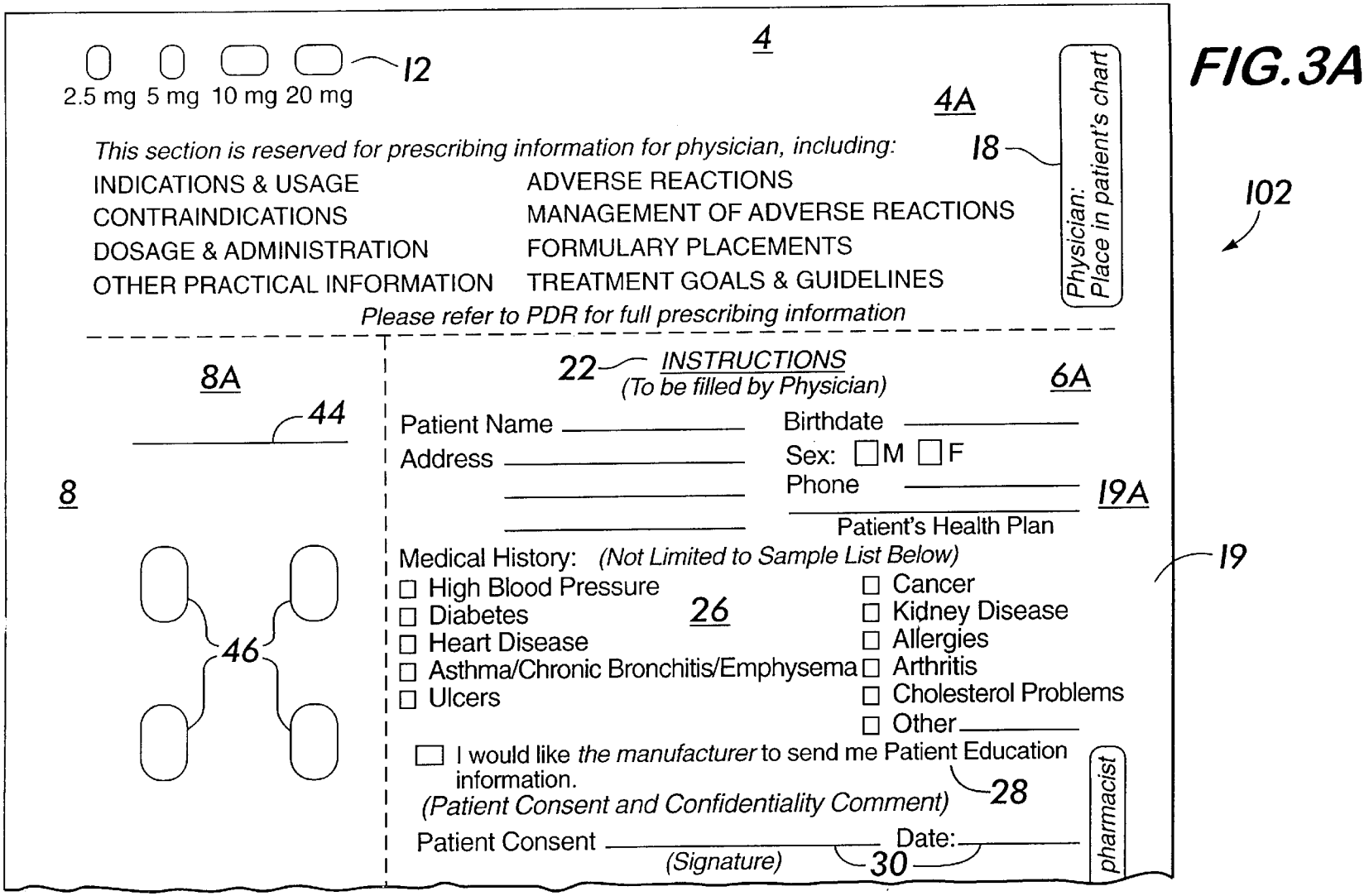
FIG. 3 is a view of the front of the second embodiment of the device.
Figure 3B:
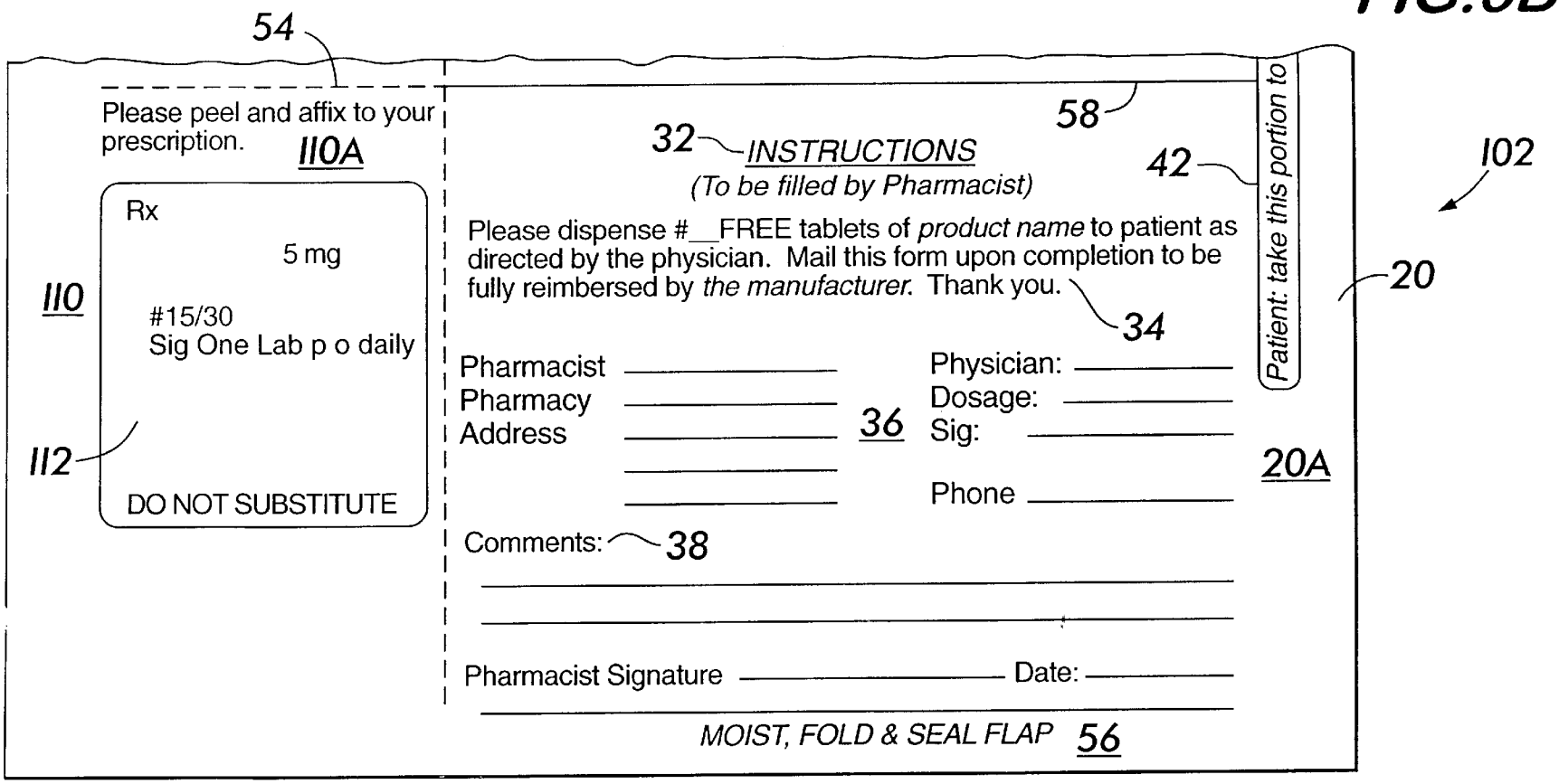

FIG. 3 shows a second embodiment of the marketing device. Marketing device 102 has the same Sections 4, 6 and 8 and back (FIG. 2) as marketing device 2. However, Section 10 of marketing device 2 which comprises patient instructions and/or a pharmacist receipt has been replaced by Section 110 which provides a peel-off 112 including information on the drug for the physician and instructions 114 to the physician to peel and affix to the physician's prescription. Also as stated previously, the back of the marketing device 2 (FIG. 2) is identical for all embodiments in this specification.

Figure 4A:
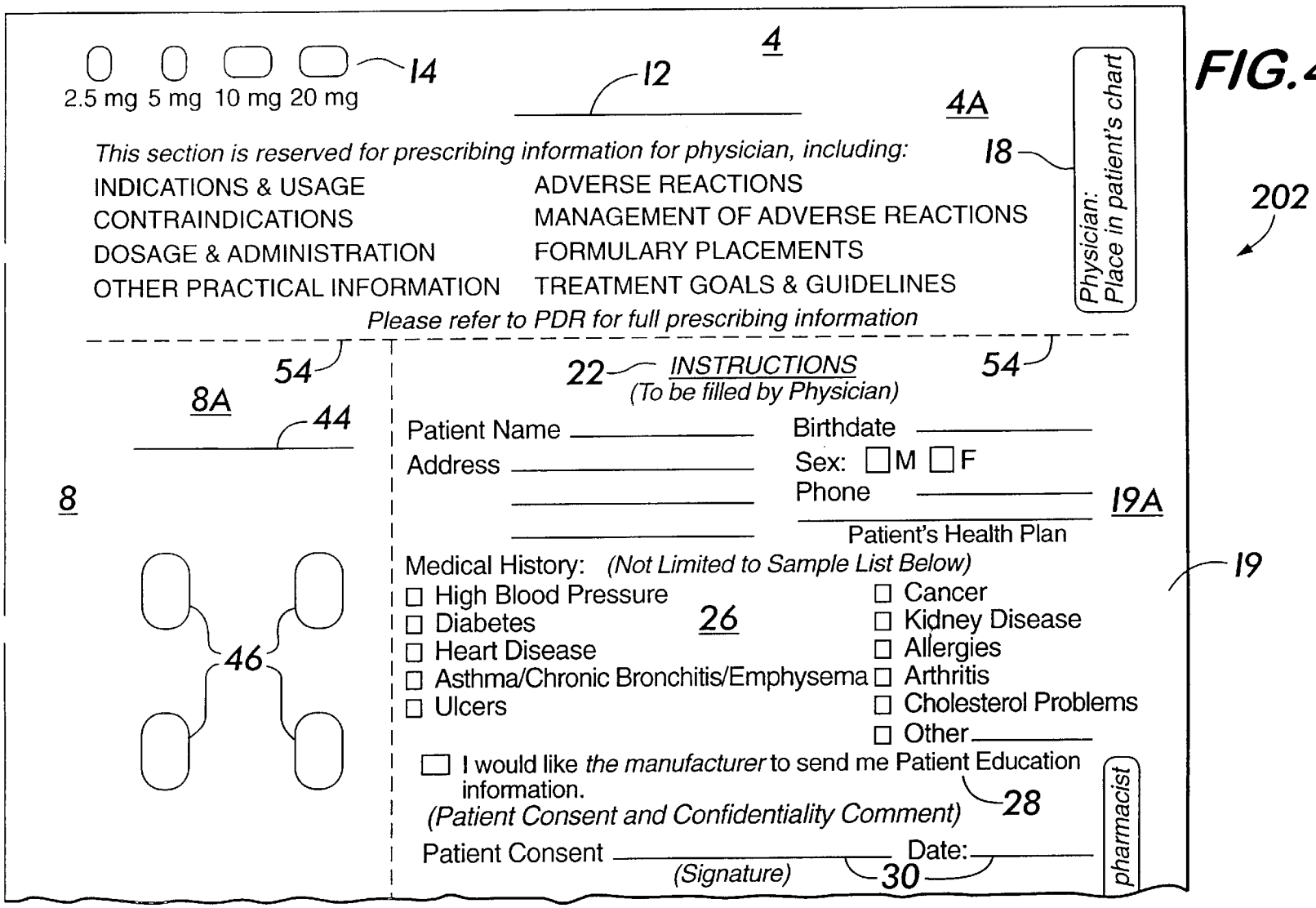
FIG. 4 is a view of the front of the third embodiment of the device.
Figure 4B:
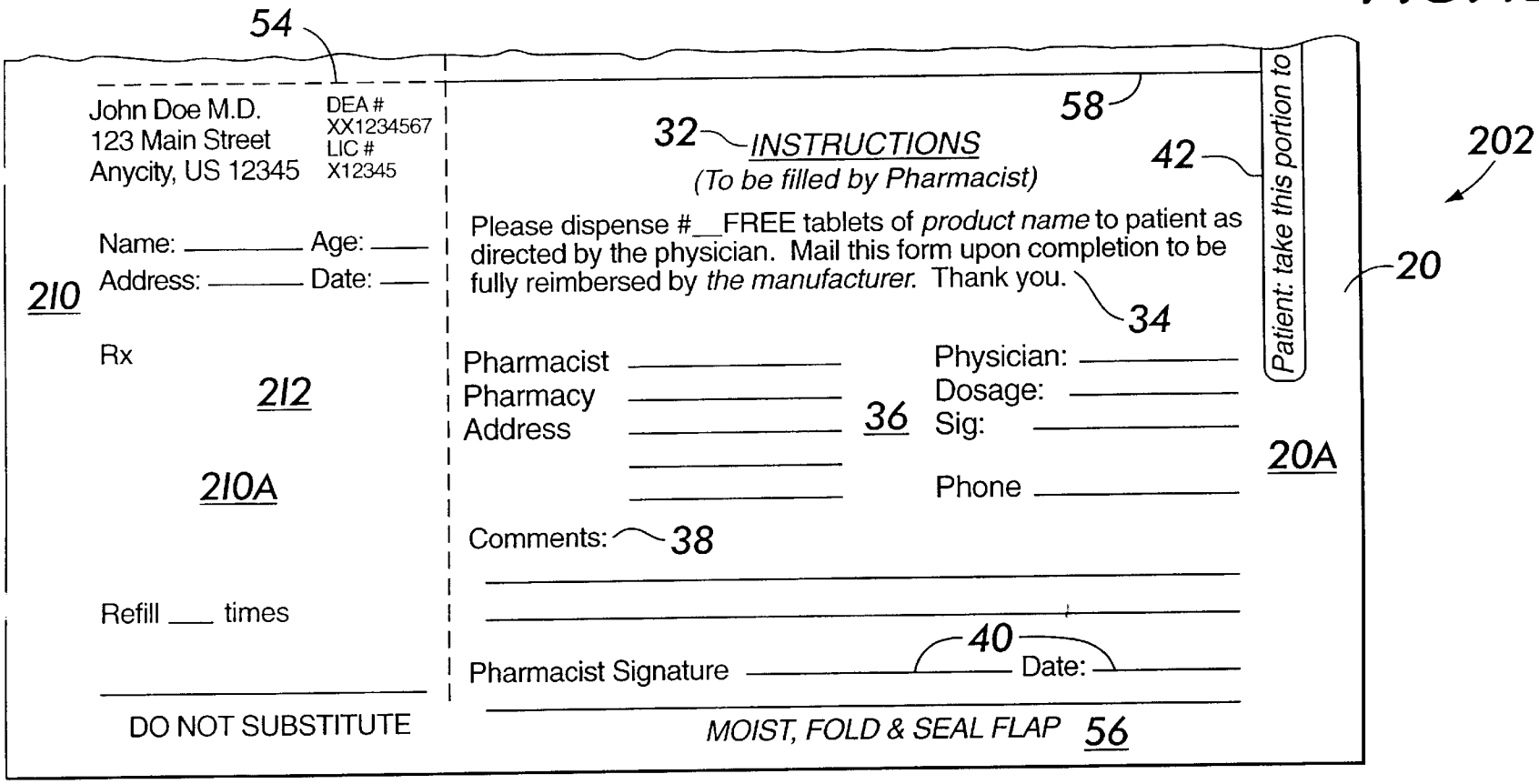

Referring now to FIG. 4, which shows a third embodiment 202 of the marketing device, marketing device 202 has identical Sections 4, 6 and 8 and back (FIG. 2) as in the first embodiment with a Section 210, having a prescription 212 to be filled out by the physician when the patient visits him, in place of Section 10. Thus, in the first two embodiments the patient takes the Section 6A to the pharmacist together with a separate prescription, but in this embodiment, the prescription is part of the marketing device 202.

The marketing system and the use of the marketing device will now be explained. The pharmaceutical company or its designated representative, which may be a marketing or database company, arranges and holds a teleconference, or any other type of promotional event, with physicians. At that time, the drug is described and agreement by the physicians to participate in the program is requested. The physicians may participate in an educational/promotional event or be educated in its use by a sales representative of the pharmaceutical company, who delivers a number of the marketing devices described above to the physician. The promotional event is an option and not essential for the use of the system/device. The system/device can be explained by the pharmaceutical sales representative.

When the physician prescribes the product for the patients in the presence of the patient, the physician separates Section 4 and attaches Section 4A to the patient's chart, fills in segment 19A of Section 6 and obtains the patient's consent and signature with regard to confidentiality of the medical history of the patient. In addition, Section 8 is separated and the patient is given the sample pills in a blister pack. Section 6 is then detached and handed to the patient by the physician with a prescription. The patient is instructed to take the Section 6 to his or her pharmacist. Of course, in the third embodiment, the prescription is written in Section 210A and given to the patient with Section 6.

The patient then goes to the pharmacist to have the prescription filled and to receive a free amount of the drug as indicated in segment 20 of Section 6. The pharmacist fills out the information in segment 20 and signs and dates segment 20A. The pharmacist then folds and seals Section 6 and mails it to the pharmaceutical company or its designated database company to obtain full reimbursement for the free amount of drugs dispensed to the patient.

The system enables the pharmaceutical company to, either directly or through its representative, a marketing and/or database company, communicate with the physician, patient and pharmacy. The pharmaceutical company can track the sample and the usage of the drug, its effectiveness and its side effects. If side effects are encountered, the pharmaceutical company can advise the physician or patient with regard to the side effects and recommend changes in frequency dosage and method of taking for administration of the drug.

Also, the system and marketing device increases the comfort level of the physician with the use of the product and results in safer and more effective use of the product by the physician. It makes available to the physician important information about the drug, including treatment guidelines, on the chart of the patient. The patient by receiving communications from the pharmaceutical company and having access to the pharmaceutical company in case of problems is reassured and better able to use the drug effectively. In addition, the pharmacist not only receives reimbursement for the free quantity of drugs, but also obtains valuable information about the drug from the pharmaceutical company and may impart that information to the patient so that he or she may provide a better service to the customers of the pharmacy.

It is expected that, by enabling the pharmaceutical company to receive information on the usage effectiveness and any side effects of a drug, and to communicate with the physicians regarding same, the physicians will be more inclined to vary the manner in which the drug is used rather than switch to another drug in case of a lack of full effectiveness or in the presence of side effects.

The term "physician" as used in this specification refers in general to any person licensed to prescribe drugs, the term "pharmacist" refers to any person licensed to dispense drugs, and the term "patient" refers to the user or recipient of the drug. Also, the filling out of the information in the various sections can be performed by any assistant to the physician or pharmacist.

As stated previously, it should also be kept in mind that although the embodiments describe a device for marketing drugs, the system and device can be used for the marketing of other products.

We claim:

1. A sampling device for marketing a drug by a pharmaceutical company, said device including multiple segments, one of said segments including the drug to be sampled and another of said segments including on one side thereof preprinted indicia providing prescribing information for a prescriber of the drug, said prescribing information including dosage and administration information, said another of said segments including an adhesive layer on the side opposite said one side for attachment to a patient's records maintained by the prescriber of the drug, whereby the prescriber is provided with easy reference to prescribing information for the drug to minimize the likelihood of the prescriber providing improper information to the dispenser of the product and to the patient.

2. The sampling device of claim 1, wherein said prescribed information also includes contraindications and adverse reaction information.

3. The sampling device of claim 1, wherein said one of said segments and said another of said segments are parts of a unitary sheet.

4. The sampling device of claim 1, wherein a release liner is attached to the adhesive side of said another of said segments, said release liner being peelable from said another of said segments to expose said adhesive layer for use in attaching said another of said segments to the patient's medical chart.

5. The sampling device of claim 1, including multiple samples of the drug and only a single segment for attachment to the patient's medical chart.

6. A method of sampling a drug by a pharmaceutical company to a user through a prescriber of the drug, said method including the steps of:

providing to the prescriber a multiple segment device having one segment with the drug to be sampled and another segment including on one side thereof preprinted indicia providing prescribing information for the prescriber of the drug, said prescribing information including dosage and administration information, said another of said segments including an adhesive layer on the side opposite said one side for attachment to a patient's records maintained by the prescriber of the drug;

said prescriber transmitting to the user the one segment with the drug to be sampled and adhering said another segment to the patient's records, whereby the prescriber is provided with easy reference to prescribing information for the drug to minimize the likelihood of the prescriber providing improper information to the dispenser of the product and to the user.

7. The method of claim 6, said prescriber adhering said another segment to the patient's medical chart.

* * * * *